US010854404B1

(12) United States Patent
Li

(10) Patent No.: US 10,854,404 B1
(45) Date of Patent: Dec. 1, 2020

(54) BACKPACK POWER-OFF RESET TEMPERATURE LIMITER

(71) Applicant: AuOne Electronic Manufacturing Limited, Foshan (CN)

(72) Inventor: Hehua Li, Foshan (CN)

(73) Assignee: AuOne Electronic Manufacturing Limited

( * ) Notice: Subject to any disclaimer, the term of this patent is extended or adjusted under 35 U.S.C. 154(b) by 0 days.

(21) Appl. No.: 16/536,268

(22) Filed: Aug. 8, 2019

(30) Foreign Application Priority Data

May 8, 2019 (CN) ..... 2019 2 0648231 U

(51) Int. Cl.

| | |
|---|---|
| ***H01H 37/64*** | (2006.01) |
| ***H01H 37/52*** | (2006.01) |
| ***H01H 37/14*** | (2006.01) |
| ***H01H 37/04*** | (2006.01) |

(52) U.S. Cl.
CPC ..... *H01H 37/64* (2013.01); *H01H 37/04* (2013.01); *H01H 37/14* (2013.01); *H01H 37/52* (2013.01)

(58) Field of Classification Search
CPC ..... H01H 37/64; H01H 37/14; H01H 37/04; H01H 37/52
USPC ..... 337/36, 72, 73, 77, 85, 89, 91, 94
See application file for complete search history.

(56) References Cited

U.S. PATENT DOCUMENTS

| | | | | |
|---|---|---|---|---|
| 5,659,285 | A * | 8/1997 | Takeda | H01H 3/001 337/333 |
| 5,847,637 | A * | 12/1998 | Takeda | H01H 37/5427 337/344 |
| 6,559,752 | B1 * | 5/2003 | Sienkiewicz | H01H 37/5418 337/343 |
| 6,577,223 | B2 * | 6/2003 | Takeda | H01H 1/504 337/333 |
| 6,633,222 | B2 * | 10/2003 | Nagai | H01H 37/54 337/333 |
| 7,026,907 | B2 * | 4/2006 | Takeda | H01H 37/5418 337/100 |
| 8,237,536 | B2 * | 8/2012 | Takeda | H01H 37/5418 337/340 |
| 2014/0334055 | A1 * | 11/2014 | Namikawa | H01H 61/01 361/115 |

(Continued)

FOREIGN PATENT DOCUMENTS

CN 204155840 U 2/2015

*Primary Examiner* — Stephen S Sul

(57) ABSTRACT

The present invention relates to the technical field of temperature controllers, and more particularly, to a backpack power-off reset temperature limiter, which comprises an insulating base, a first terminal, a second terminal, a power-receiving elastic piece and an arch-shaped temperature sensing sheet. The power-receiving elastic piece is arranged on the upper end surface of the insulating base. One end of the power-receiving elastic piece is fixedly connected with the first terminal, and the other free end of the power-receiving elastic piece is electrically connected with the second terminal. The two ends of the power-receiving elastic piece are respectively provided with a fixing clamping position that is clamped with an end part of the temperature sensing sheet, and the two sides of the power-receiving elastic piece are respectively provided with an assembly clamping position that is matched with the temperature sensing sheet.

5 Claims, 2 Drawing Sheets

(56) References Cited

U.S. PATENT DOCUMENTS

| | | | | |
|---|---|---|---|---|
| 2015/0035641 | A1* | 2/2015 | Mochizuki | H01H 69/02<br>337/35 |
| 2017/0062161 | A1* | 3/2017 | Takeda | H01H 37/52 |
| 2017/0062167 | A1* | 3/2017 | Tanaka | H01H 37/52 |
| 2018/0233310 | A1* | 8/2018 | Tanaka | C22C 22/00 |

* cited by examiner

BACKPACK POWER-OFF RESET TEMPERATURE LIMITER

TECHNICAL FIELD OF THE INVENTION

The present invention relates to the technical field of temperature controllers, and more particularly to a backpack power-off reset temperature limiter.

BACKGROUND OF THE INVENTION

A temperature sensor is a temperature-sensitive controller with self-action protection, open-circuit keeping and self-resetting power switch function, which has a wide application. It protects the safety of electrical circuits and avoids damages caused by excessively high working temperatures. Temperature sensors are widely used in the field of small household appliances such as intelligent rice cookers and pressure cookers. Except for realizing the automatic heating control through the temperature detection, the safety requirement of overheating protection is also mandatory in Household Appliance Safety Standards such as GB4706.1.

In the prior art, there're various temperature controllers sold on the market, a common one of which is the bimetal-sheet overheating temperature controller. Its principle is to sense the working temperature of an electric appliance through contact. When the temperature reaches a critical point, the bimetal sheet springs up and deforms, and the power-receiving terminal is driven to cut-off the circuit, enabling the electric appliance to be rapidly powered off. Thus, the purposes of overheating protection and power-off control can be achieved. For the bimetal sheet of the temperature controller acts instantly at the critical point, enough space in the temperature controller is needed for allowing the bimetal sheet and the power-receiving terminal to spring up. However, the bimetal sheet and the power-receiving terminal are easy to fall off because they are not firmly fixed.

Chinese patent CN204155840U also discloses a temperature controller, which comprises a base, a PTC heating element, an elastic piece and a temperature piece, wherein the elastic piece is arranged on the upper surface of the base, and an elastic piece clamping position is arranged on the upper surface of the elastic piece, wherein the upper surface of the base is provided with a base clamping position, the base clamping position penetrates through the elastic piece, and interacts with the elastic piece clamping position to clamp the temperature piece. Clamping grooves that interact with the elastic piece clamping position and the base clamping position are formed in the temperature piece. Although the aforesaid design prevents the temperature piece from falling off at a certain degree, the structure of each part is too complex to achieve an easy assembly.

Thus, it's urgent for those skilled in the art to develop a novel temperature limiter.

SUMMARY OF THE INVENTION

The purpose of the present invention is to solve the shortcomings in the prior art by providing a backpack power-off reset temperature limiter, which has a reasonable structure, can be conveniently assembled, and is collision-proof and electric-arc-proof.

To achieve the above purpose, the present invention adopts the following technical solution:

A backpack power-off reset temperature limiter comprising an insulating base, a first terminal, a second terminal, a power-receiving elastic piece and an arch-shaped temperature sensing sheet; the first terminal and the second terminal are respectively connected to the two ends of the insulating base in an injection molding mode, and the power-receiving elastic piece is arranged on the upper end surface of the insulating base; one end of the power-receiving elastic piece is fixedly connected with the first terminal, and the other free end of the power-receiving elastic piece are electrically connected with the second terminal; the temperature sensing sheet is arranged on the upper surface of the power-receiving elastic piece; the two ends of the power-receiving elastic piece are respectively provided with a fixing clamping position that is clamped with an end part of the temperature sensing sheet, and the two sides of the power-receiving elastic piece are respectively provided with an assembly clamping position that is matched with the temperature sensing sheet.

In another aspect of the invention, the two ends of the insulating base are respectively provided with an injection molding hole, and the injection molding hole is a mold-open preformed hole. A first folding plate is arranged on the first terminal, and a second folding plate is arranged on the second terminal. The first folding plate and the second folding plate are respectively inserted into the corresponding injection molding hole, and the first terminal, the second terminal and the insulating base are connected into an integral structure by means of injection molding. The upper end surfaces of the first folding plate and the second folding plate are exposed on the upper end surface of the insulating base, and vertical through-holes are formed in the first folding plate and the second folding plate.

In another aspect of the invention, the assembly clamping position comprises limiting lug pieces and introducing lug pieces. At least two limiting lug pieces are arranged on one side of the power-receiving elastic piece, and at least two introducing lug pieces are arranged on the other side of the power-receiving elastic piece. The included angle between the introducing lug piece and the power-receiving elastic piece is larger than 120 degrees.

In another aspect of the invention, Anti-off clamping positions are arranged on the two sides of the upper end surface of the insulating base, and anti-collision guard plates are arranged at the two ends of the upper end surface of the insulating base.

In another aspect of the invention, a stationary contact is arranged on the through-hole of the second folding plate, and a movable contact is arranged on the other end of the power-receiving elastic piece. The two sides of the anti-collision guard plate corresponding to the movable contact are respectively provided with an insulating guard plate.

In another aspect of the invention, a guide cone convex column is arranged on the upper end surface of the insulating base, and a limiting hole is formed in the middle of the power-receiving elastic piece. The guide cone convex column is arranged in the limiting hole in a penetrating mode, and the upper end of the guide cone convex column is arranged to correspond to the concave surface of the temperature sensing sheet.

In another aspect of the invention, the temperature limiter of the present invention further comprises a PTC heating element and a power-receiving wrapping sheet. An accommodating cavity is formed in the bottom surface of the insulating base, and the PTC heating element is arranged in the accommodating cavity. A folding lug piece is arranged on the second terminal. One end of the folding lug piece penetrates into the accommodating cavity, and is electrically connected with the upper end surface of the PTC heating element. The power-receiving wrapping sheet is a Z-shaped bent sheet, and one end of the power-receiving wrapping sheet is attached to the lower end surface of the PTC heating element. The other end of the power-receiving wrapping sheet and one end of the power-receiving elastic piece are riveted and fixed with the through-hole in the first folding plate.

Compared with the prior art, the present invention has the following advantages:

The present invention has a reasonable structure. The temperature sensing sheet can be quickly installed into the power-receiving elastic piece through the introducing clamping position. The fixing clamping position and the assembly clamping position interact to limit the position of the temperature sensing sheet, thereby preventing the temperature sensing sheet from displacing and falling off when the temperature sensing sheet suddenly springs up and deforms. The anti-off clamping positions can prevent the temperature sensing sheet from falling off from the power-receiving elastic piece. Meanwhile, the anti-off clamping positions and the anti-collision guard plates form a four-surfaced protection for the power-receiving elastic piece and the temperature sensing sheet. Further, the insulating guard plates surround the stationary contact, thereby preventing the electric sparks from being released. The structure is compact, the matching is stable, and the assembly is convenient.

1—Insulating Base, 2—Power-receiving Elastic Piece, 3—Temperature-sensing Sheet, 4—PTC Heating Element, 10—Injection Molding Hole, 100—Through-hole, 11—The First Terminal, 111—The First Folding Plate, 12—The Second Terminal, 121—The Second Folding Plate, 13—Anti-off Clamping Position, 14—Anti-collision Guard Plate, 15—Stationary Contact, 16—Guide Cone Convex Column, 17—Accommodating Cavity, 18—Folding Lug Piece, 21—Fixing Clamping Position, 22—Limiting Lug Piece, 23—Introducing Lug Piece, 24—Limiting Hole, 25—Movable Contact.

DETAILED DESCRIPTION OF THE INVENTION

Drawings and detailed embodiments are combined hereinafter to elaborate the technical principles of the present invention.

Figure 1:
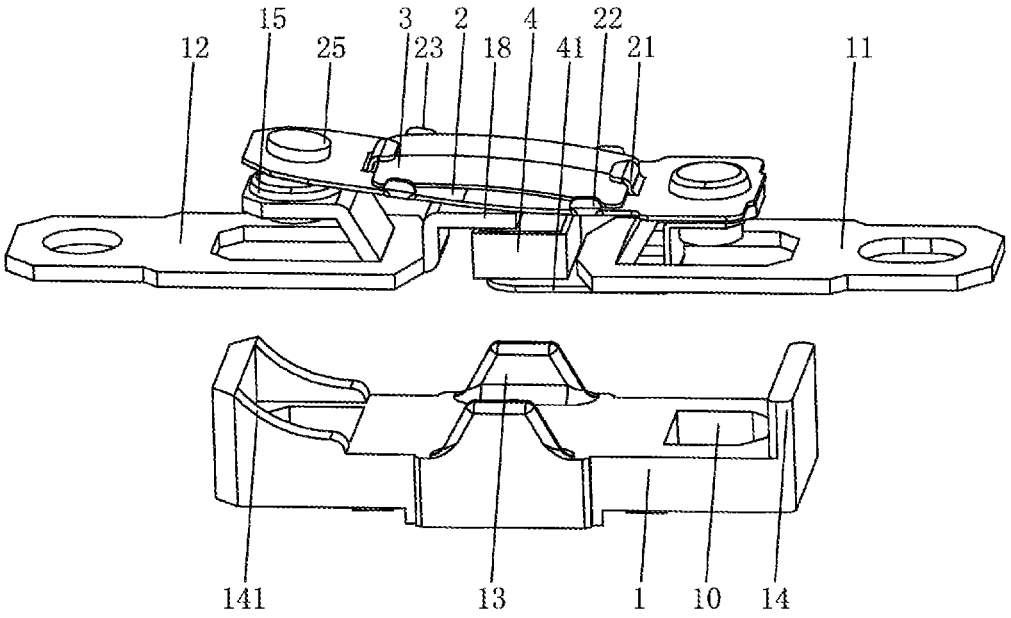
FIG. 1 is a schematic diagram illustrating the split structure of the insulating base of the present invention.
Figure 2:
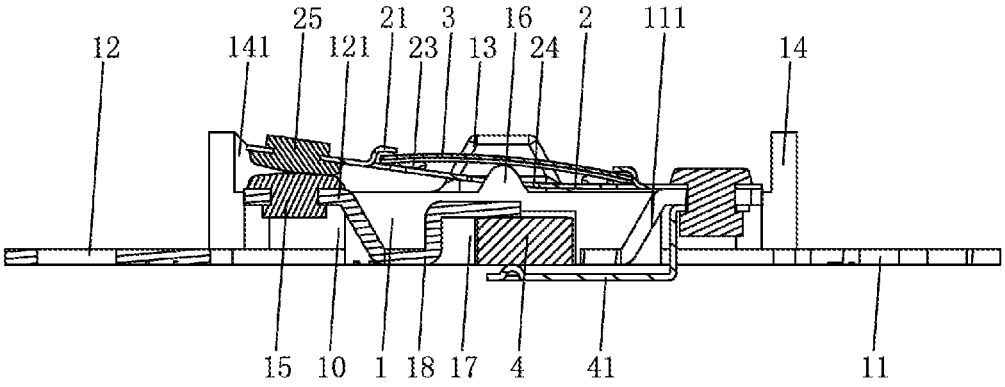
FIG. 2 is a sectional view of the present invention.
Figure 3:
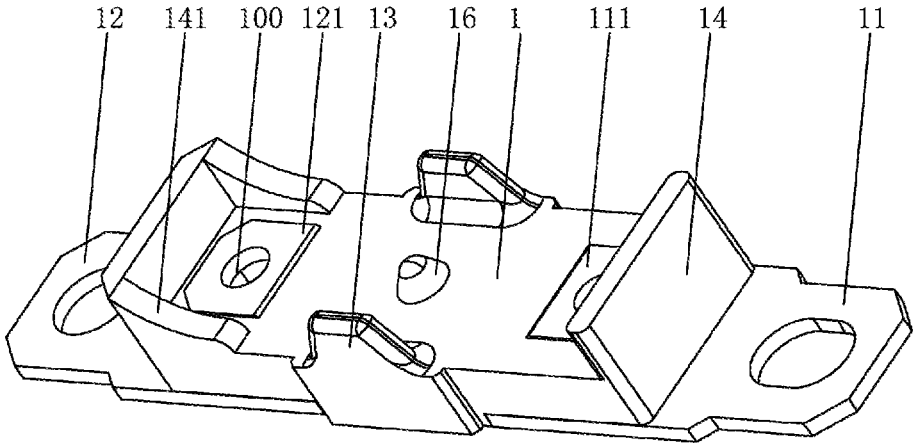
FIG. 3 is a schematic diagram illustrating the injection molding structure of the insulating base of the present invention.
Figure 4:
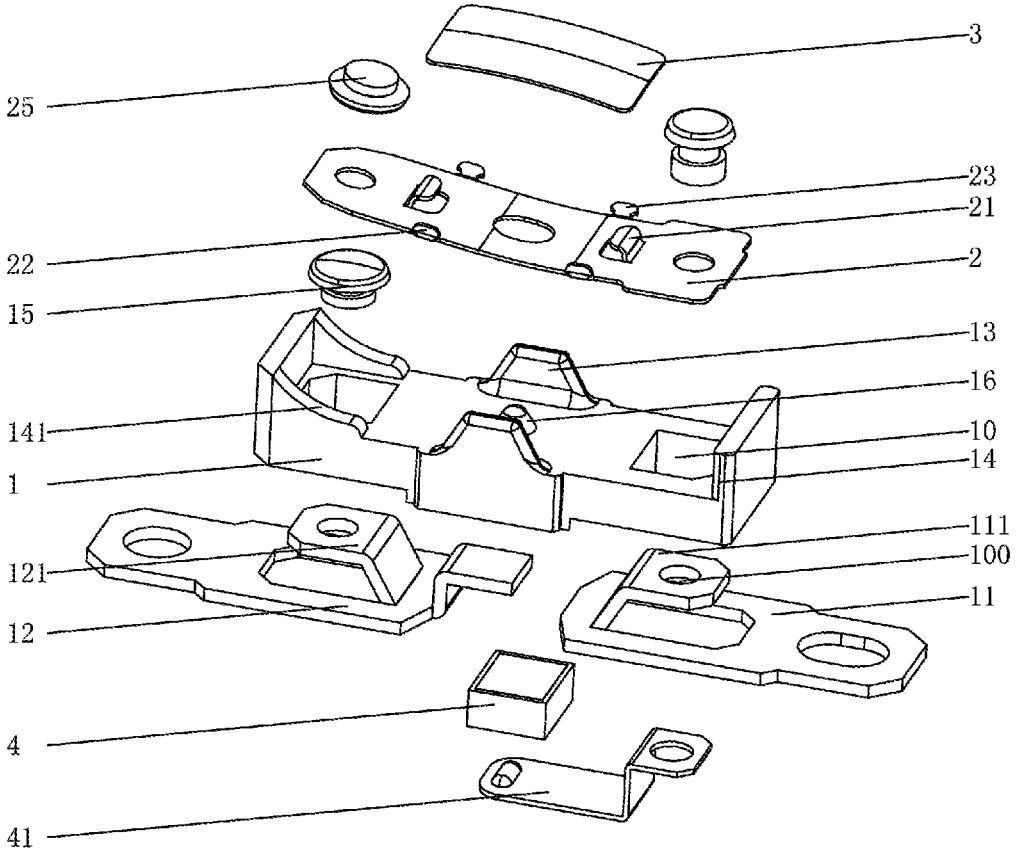
FIG. 4 is an explosive view of the present invention.

As shown in FIGS. 1-4, a backpack power-off reset temperature limiter comprises an insulating base 1, a first terminal 11, a second terminal 12, a power-receiving elastic piece 2 and an arch-shaped temperature sensing sheet 3. The first terminal 11 and the second terminal 12 are respectively connected to the two ends of the insulating base 1 in an injection molding mode, and the power-receiving elastic piece 2 is arranged on the upper end surface of the insulating base 1. One end of the power-receiving elastic piece 2 is fixedly connected with the first terminal 11, and the other free end of the power-receiving elastic piece 2 are electrically connected with the second terminal 12. The temperature sensing sheet 3 is arranged on the upper surface of the power-receiving elastic piece 2. The two ends of the power-receiving elastic piece 2 are respectively provided with a fixing clamping position 21 that is clamped with an end part of the temperature sensing sheet 3, and the two sides of the power-receiving elastic piece 2 are respectively provided with an assembly clamping position that is matched with the temperature sensing sheet 3. The aforesaid components form the main structure of the present invention. The insulating base 1 is used for accommodating various components for installing a temperature limiter. The insulating base 1, the first terminal 11 and the second terminal 12 are integrally formed through injection molding. Thus, higher processing and assembly efficiencies can be achieved. The first terminal 11, the second terminal 12 and the power-receiving elastic piece 2 are made of conductive materials, thereby forming the on-off switching of the working circuit. The temperature sensing sheet 3 is a bimetal sheet with a shape memory function. When the working temperature exceeds a critical value, the temperature sensing sheet 3 can drive the free end of the power-receiving elastic piece 2 to spring up through self-deformation, thereby cutting off the electric connection between the first terminal 11 and the second terminal 12. Thus, the working circuit is cut off After the temperature drops, the temperature sensing sheet 3 recovers to its original shape, enabling the power-receiving elastic piece 2 to switch-on the working circuit. The fixing clamping positions 21 and the assembly clamping positions surround the temperature sensing sheet 3 from its periphery, thereby preventing the temperature sensing sheet 3 from being separated from the power-receiving elastic piece 2 due to its sudden springing up. As the two fixing clamping positions 21 are arranged on the power-receiving elastic piece 2, before integrally assembly the temperature limiter, the temperature sensing sheet 3 can be pre-installed on the power-receiving elastic piece 2. Therefore, the assembly process can be simplified so that the assembly efficiency can be effectively improved.

The two ends of the insulating base 1 are respectively provided with an injection molding hole 10, and the injection molding hole 10 is a mold-open preformed hole. A first folding plate 111 is arranged on the first terminal 11, and a second folding plate 121 is arranged on the second terminal 12. The first folding plate 111 and the second folding plate 121 are respectively inserted into the corresponding injection molding hole 10, and the first terminal 11, the second terminal 12 and the insulating base 1 are connected into an integral structure by means of injection molding. The upper end surfaces of the first folding plate 111 and the second folding plate 121 are exposed on the upper end surface of the insulating base 1, and vertical through-holes 100 are formed in the first folding plate 111 and the second folding plate 121. The through-hole 100 is a preformed hole during the integral injection molding of the insulating base 1, and the lower end of the through-hole 100 penetrates through the lower end surface of the insulating base 1, thereby facilitating the later assembly of other parts of the temperature limiter. The first terminal 11 and the first folding plate 111, and the second terminal 12 and the second folding plate 121 are integrally punch-formed structures, and the injection molding process of the insulating base 11 forms an integral structure of the first terminal 11 and the second terminal 12. In this way, the structural strength and the insulating performance of the product can be significantly enhanced, and the assembly process can be greatly simplified.

The assembly clamping position comprises limiting lug pieces 22 and introducing lug pieces 23. At least two limiting lug pieces 22 are arranged on one side of the power-receiving elastic piece 2, and at least two introducing lug pieces 23 are arranged on the other side of the power-receiving elastic piece 2. The included angle between the introducing lug piece 23 and the power-receiving elastic piece 2 is larger than 120 degrees.

The limiting lug piece 22 is vertical to the power-receiving elastic piece 2, and the limiting lug piece 22 limits the transverse displacement of the temperature sensing sheet 3 from one side of the power-receiving elastic piece 2. Preferably, there're two limiting lug pieces 22, and the two limiting lug pieces 22 are respectively arranged at the two ends of the temperature sensing sheet 3. An inclined angle larger than 120 degrees is formed between the introducing lug piece 23 and the power-receiving elastic piece 2. Preferably, there're two introducing lug pieces, and the two introducing lug pieces are respectively arranged at the two ends of the temperature sensing sheet 3, thereby allowing the temperature sensing sheet 3 to be arranged obliquely between two fixing clamping positions 21. Meanwhile, the introducing lug piece 23 can limit the transverse displacement of the temperature sensing sheet 3 from the other side, thus preventing the temperature sensing sheet 3 from falling off when springing up suddenly. Thus, the working stability of the temperature limiter can be ensured.

Anti-off clamping positions 13 are arranged on the two sides of the upper end surface of the insulating base 1, and anti-collision guard plates 14 are arranged at the two ends of the upper end surface of the insulating base 1. The anti-off clamping positions 13 are used for limiting the temperature sensing sheet 3 from the two sides. For the introducing lug pieces 23 are obliquely arranged, in order to conveniently install the temperature sensing sheet 3, the two introducing lug pieces 23 are arranged at the two ends nearby the temperature sensing piece 3. The height-control range of the transverse limit of the introducing lug piece 23 is limited. The anti-off clamping position 13 is arranged between the two introducing lug pieces 23, and the apex of the anti-off clamping position 13 is higher than the arch top of the temperature sensing sheet 3. Thus, through the interaction between the limiting lug pieces 22 on one side and the anti-off clamping positions 13 on the other side, the temperature sensing sheet 3 can be protected from sliding out from the two fixing clamping positions 21. Therefore, the temperature sensing sheet 3 can be prevented from falling off from the power-receiving elastic piece 2.

Further, the anti-collision guard plates 14 guard the power-receiving elastic piece 2 from the two ends of the insulating base 1. A stationary contact 15 is arranged on the through-hole 100 of the second folding plate 121, and a movable contact 25 is arranged on the other end of the power-receiving elastic piece 2. The two sides of the anti-collision guard plate 14 corresponding to the movable contact 25 are respectively provided with an insulating guard plate 141. The arc-discharge occurred between the movable contact 25 and the stationary contact 15 can be avoided by increasing the contact area. However, the on-off action of the power-receiving elastic piece 2 generates electric sparks. The anti-collision guard plate 14 and the insulating guard plates 141 on the two sides form a three-surfaced surrounding of the movable contact 25, thus preventing the electric sparks from being released.

A guide cone convex column 16 is arranged on the upper end surface of the insulating base 1, and a limiting hole 24 is formed in the middle of the power-receiving elastic piece 2. The guide cone convex column 16 is arranged in the limiting hole 24 in a penetrating mode, and the upper end of the guide cone convex column 16 is arranged to correspond to the concave surface of the temperature sensing sheet 3. The limiting hole 24 and the guide cone convex column 16 form a shaft-hole-fit, thereby avoiding the transverse deviation of the power-receiving elastic piece 2 during the on-off action. In the power-on state, the guide cone convex column 15 and the concave surface of the temperature sensing sheet 3 form a virtual-contact connection. Namely, a gap exists between the top end of the guide cone convex column 15 and the temperature sensing sheet 3. When the temperature of the temperature sensing sheet 3 exceeds the critical value, the temperature sensing sheet 3 turns over so that the convex surface of the temperature sensing sheet 3 faces downwards, thereby abutting against the cone convex column 15 and pushing the free end of the power-receiving elastic piece 2 to spring up. Thus, the working circuit can be cut off.

The present invention further comprises a PTC heating element 4 and a power-receiving wrapping sheet 41. An accommodating cavity 17 is formed in the bottom surface of the insulating base 1, and the PTC heating element 4 is arranged in the accommodating cavity 17. A folding lug piece 18 is arranged on the second terminal 12, one end of the folding lug piece 18 penetrates into the accommodating cavity 17, and is electrically connected with the upper end surface of the PTC heating element 4. The first terminal 11, the power-receiving wrapping sheet 41, the PTC heating element 4, the folding lug piece 18 and the second terminal 12 form a heat-keeping circuit. When the power-receiving elastic piece 2 is in the springing-up state, the heat-keeping circuit is in a power-on state. The PTC heating element 4 works to ensure that the temperature of the temperature sensing sheet 3 is higher than the reset temperature. The power-receiving wrapping sheet 41 is a Z-shaped bent sheet, and one end of the power-receiving wrapping sheet 41 is attached to the lower end surface of the PTC heating element 4. The other end of the power-receiving wrapping sheet 41 and one end of the power-receiving elastic piece 2 are riveted and fixed with the through-hole 100 in the first folding plate 111. The power-receiving wrapping sheet 41 serves as a fixing mechanism of the PTC heating element 4. Meanwhile, through rivet-connecting the power-receiving wrapping sheet 41 with the power-receiving elastic piece 2 and the through-hole 100 in the first folding plate 111, the assembly process can be finally completed. In this way, the assembly efficiency can be integrally improved.

The above description is only the preferred embodiments of the present invention and does not limit the patent scope of the present invention, any equivalent structure or equivalent process modification used according to the contents of the specification and accompanying drawings in the present invention, no matter whether it is directly or indirectly used in any other related technical field, should be included within the protection scope of the present invention.

The invention claimed is:

1. A backpack power-off reset temperature limiter, comprising:

an insulating base (1), a first terminal (11), a second terminal (12), a power-receiving elastic piece (2), and an arch-shaped temperature sensing sheet (3), wherein the first terminal (11) and the second terminal (12) are respectively connected to two ends of the insulating base (1) in an injection molding mode, and the power-receiving elastic piece (2) is arranged on an upper end surface of the insulating base (1), wherein one end of the power-receiving elastic piece (2) is fixedly connected with the first terminal (11), and an other free end of the power-receiving elastic piece (2) are electrically connected with the second terminal (12), wherein the temperature sensing sheet (3) is arranged on an upper surface of the power-receiving elastic piece (2), wherein two ends of the power-receiving elastic piece (2) are respectively provided with a fixing clamping position (21) that is clamped with an end part of the temperature sensing sheet (3), and two sides of the power-receiving elastic piece (2) are respectively provided with an assembly clamping position that is matched with the temperature sensing sheet (3), wherein the two ends of the insulating base (1) are respectively provided with an injection molding hole (10), wherein a first folding plate (111) is arranged on the first terminal (11), and a second folding plate (121) is arranged on the second terminal (12), wherein the first folding plate (111) and the second folding plate (121) are respectively inserted into the corresponding injection molding hole (10), and the first terminal (11), the second terminal (12) and the insulating base (1) are connected into an integral structure by means of injection molding, wherein an upper end surfaces of the first folding plate (111) and the second folding plate (121) are exposed on the upper end surface of the insulating base (1), and vertical through-holes (100) are formed in the first folding plate (111) and the second folding plate (121), wherein the assembly clamping position comprises limiting lug pieces (22) and introducing lug pieces (23), wherein at least two limiting lug pieces (22) are arranged on one side of the power-receiving elastic piece (2), and at least two introducing lug pieces (23) are arranged on the other side of the power-receiving elastic piece (2), wherein an included angle between the introducing lug piece (23) and the power-receiving elastic piece (2) is larger than 120 degrees.

2. The backpack power-off reset temperature limiter of claim 1, wherein anti-off clamping positions (13) are arranged on two sides of the upper end surface of the insulating base (1), and anti-collision guard plates (14) are arranged at the two ends of the upper end surface of the insulating base (1).

3. The backpack power-off reset temperature limiter of claim 2, wherein a stationary contact (15) is arranged on the through-hole (100) of the second folding plate (121), and a movable contact (25) is arranged on the other free end of the power-receiving elastic piece (2), wherein the two sides of the anti-collision guard plate (14) corresponding to the movable contact (25) are respectively provided with an insulating guard plate (141).

4. The backpack power-off reset temperature limiter of claim 1, wherein a guide cone convex column (16) is arranged on the upper end surface of the insulating base (1), and a limiting hole (24) is formed in the middle of the power-receiving elastic piece (2), wherein the guide cone convex column (16) is arranged in the limiting hole (24) in a penetrating mode, and the upper end of the guide cone convex column (16) is arranged to correspond to the concave surface of the temperature sensing sheet (3).

5. A backpack power-off reset temperature limiter, comprising:

an insulating base (1), a first terminal (11), a second terminal (12), a power-receiving elastic piece (2), and an arch-shaped temperature sensing sheet (3), wherein the first terminal (11) and the second terminal (12) are respectively connected to two ends of the insulating base (1) in an injection molding mode, and the power-receiving elastic piece (2) is arranged on an upper end surface of the insulating base (1), wherein one end of the power-receiving elastic piece (2) is fixedly connected with the first terminal (11), and an other free end of the power-receiving elastic piece (2) are electrically connected with the second terminal (12), wherein the temperature sensing sheet (3) is arranged on an upper surface of the power-receiving elastic piece (2), wherein two ends of the power-receiving elastic piece (2) are respectively provided with a fixing clamping position (21) that is clamped with an end part of the temperature sensing sheet (3), and two sides of the power-receiving elastic piece (2) are respectively provided with an assembly clamping position that is matched with the temperature sensing sheet (3), wherein the temperature limiter further comprises a PTC heating element (4) and a power-receiving wrapping sheet (41), an accommodating cavity (17) is formed in the bottom surface of the insulating base (1), and the PTC heating element (4) is arranged in the accommodating cavity (17), wherein a folding lug piece (18) is arranged on the second terminal (12), one end of the folding lug piece (18) penetrates into the accommodating cavity (17), and is electrically connected with an upper end surface of the PTC heating element (4), wherein the power-receiving wrapping sheet (41) is a Z-shaped bent sheet, and one end of the power-receiving wrapping sheet (41) is attached to the lower end surface of the PTC heating element (4), wherein an other end of the power-receiving wrapping sheet (41) and one end of the power-receiving elastic piece (2) are riveted and fixed with the through-hole (100) in a first folding plate (111).

* * * * *